US009012115B2

(12) United States Patent
Ujifusa et al.

(10) Patent No.: US 9,012,115 B2
(45) Date of Patent: Apr. 21, 2015

(54) YELLOW TONER

(75) Inventors: Takayuki Ujifusa, Ashigarakami-gun (JP); Taichi Shintou, Saitama (JP); Yutaka Tani, Yokohama (JP); Masao Nakano, Kamakura (JP); Kaoru Takahashi, Saitama (JP); Satoshi Saito, Mishima (JP); Takeshi Miyazaki, Ebina (JP); Masashi Hirose, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/116,998

(22) PCT Filed: Jun. 21, 2012

(86) PCT No.: PCT/JP2012/066456

§ 371 (c)(1),
(2), (4) Date: Nov. 11, 2013

(87) PCT Pub. No.: WO2013/002294

PCT Pub. Date: Jan. 3, 2013

(65) Prior Publication Data

US 2014/0080049 A1 Mar. 20, 2014

(30) Foreign Application Priority Data

Jun. 28, 2011 (JP) ..... 2011-142669

(51) Int. Cl.
*G03G 9/09* (2006.01)

(52) U.S. Cl.
CPC ..... *G03G 9/0924* (2013.01); *G03G 9/0906* (2013.01)

(58) Field of Classification Search
USPC ..... 430/108.1, 108.2, 108.21
See application file for complete search history.

(56) References Cited

U.S. PATENT DOCUMENTS 5,889,541 A 3/1999 Borrow et al.
7,696,380 B2 4/2010 Kitagawa et al.

(Continued)

FOREIGN PATENT DOCUMENTS

JP 60-252655 A 12/1985
JP 7-242610 A 9/1995

(Continued)

OTHER PUBLICATIONS

Translation of abstract of JP 2005-106932 published Apr. 2005.*

(Continued)

*Primary Examiner* — Peter Vajda
(74) *Attorney, Agent, or Firm* — Fitzpatrick, Cella, Harper and Scinto

(57) ABSTRACT

To provide a yellow toner having a colorant in a good dispersed state, obtained through excellent granulation performance and having stable developing performance, the yellow toner contains a binder resin, a wax and a colorant, and is characterized by containing as the colorant a compound represented by the following general formula (1) and a compound represented by the following general formula (2).

General formula (1)

General formula (2)

4 Claims, 3 Drawing Sheets

(56) References Cited

U.S. PATENT DOCUMENTS

| | | | | |
|---|---|---|---|---|
| 7,833,685 | B2 | 11/2010 | Tanaka et al. | |
| 8,211,606 | B2 | 7/2012 | Murai et al. | |
| 2011/0008723 | A1 | 1/2011 | Morita et al. | |
| 2011/0146537 | A1 * | 6/2011 | Goredema et al. | 106/311 |
| 2014/0134531 | A1 | 5/2014 | Mori et al. | |
| 2014/0170553 | A1 | 6/2014 | Mori et al. | |

FOREIGN PATENT DOCUMENTS

| | | | | |
|---|---|---|---|---|
| JP | 2002-372832 | A | 12/2002 | |
| JP | 2005-106932 | * | 4/2005 | G03G 9/09 |
| JP | 2005-106932 | A | 4/2005 | |
| JP | 2007-156168 | A | 6/2007 | |
| JP | 4053633 | B2 | 2/2008 | |
| JP | 2008-274126 | A | 11/2008 | |
| WO | 2005/037770 | A1 | 4/2005 | |
| WO | 2012/153669 | A1 | 11/2012 | |

OTHER PUBLICATIONS

PCT International Search Report and Written Opinion of the International Searching Authority, International Application No. PCT/JP2012/066456, Mailing Date Sep. 11, 2012.

European Search Report dated Feb. 5, 2015 in European Application No. 12804106.8.

* cited by examiner

YELLOW TONER

TECHNICAL FIELD

The present invention relates to a yellow toner used in recording processes such as electrophotography, electrostatic recording, magnetic recording and toner jet recording.

BACKGROUND ART

In recent years, there is an increasing demand for higher image quality because color images have become greatly popular. In full-color digital copying machines or printers, a color image original is color-separated with color filters of blue, green and red, and thereafter latent images corresponding to original images are developed with use of developers for respective colors of yellow, magenta, cyan and black. Hence, it follows that the coloring power a colorant has which is contained in the developer for each color has a great influence on image quality.

As typical examples of pigments having high transparency and coloring power for yellow, there are pigments having an isoindolinone skeleton as typified by C.I. Pigment Yellow 185. As to C.I. Pigment Yellow 185, some examples of its application to toners are also known in the art (see PTL 1).

CITATION LIST

Patent Literature

PTL 1: Japanese Patent Application Laid-open No. 2005-106932

SUMMARY OF INVENTION

Technical Problem

C.I. Pigment Yellow 185 has had a great problem that, because of a characteristic feature of the pigment, it tends to undergo self-agglomeration and is unable to achieve any sufficiently dispersed state as a pigment contained in a binder resin. In particular, it has had a great problem that, in a production process having the step of forming toner particles by granulation in an aqueous medium, any toner particle size distribution for the desired particle diameter comes so broad as to give rise to coarse powder and fine powder.

As the result, it has come about that fine lines in images come to have low sharpness or that development streaks appear or image fog occurs in which the toner adheres to non-image area. Further, various problems such as toner-spent to carrier particle surfaces, toner filming to drums and fixing-roller staining have also come about in some cases.

Accordingly, it has been a very important technical subject to improve the dispersibility of C.I. Pigment Yellow 185 and colorants structurally similar thereto.

Solution to Problem

The present invention is concerned with a yellow toner comprising yellow toner particles each containing a binder resin, a wax and a colorant, and the colorant comprises a compound represented by the following general formula (1) and a compound represented by the following general formula (2).

General formula (1)

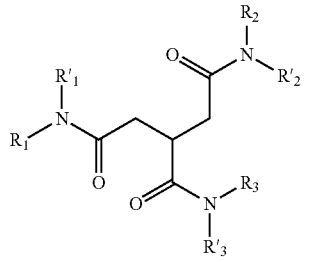

In the general formula (1), $R_1$, $R_2$, $R_3$, $R'_1$, $R'_2$ and $R'_3$ each independently represent a hydrogen atom, an alkyl group, an aryl group or an aralkyl group, and any of these may have a substituent.

General formula (2)

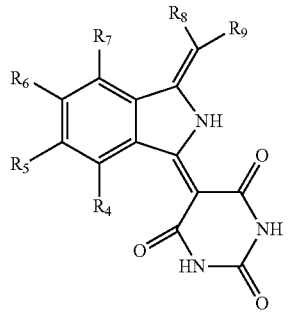

In the general formula (2), $R_4$ to $R_7$ each independently represent a hydrogen atom, a halogen atom, a sulfonic acid group, a sulfonic acid ester group, a sulfonic acid amide group, a sulfonic acid salt group, a carboxylic acid group, a carboxylic acid ester group, a carboxylic acid amide group or a carboxylic acid salt group; $R_8$ and $R_9$ each independently represent a hydrogen atom, a cyano group, a carboxylic acid group, a carboxylic acid ester group, a carboxylic acid amide group, a carboxylic acid salt group or a heterocyclic group; and $R_7$ and $R_8$, or $R_8$ and $R_9$, may each independently combine to form a ring.

Advantageous Effects of Invention

According to the present invention, it can provide a yellow toner having the colorant in a good dispersed state.

Further features of the present invention will become apparent from the following description of exemplary embodiments with reference to the attached drawings.

DESCRIPTION OF EMBODIMENTS

Figure 1:
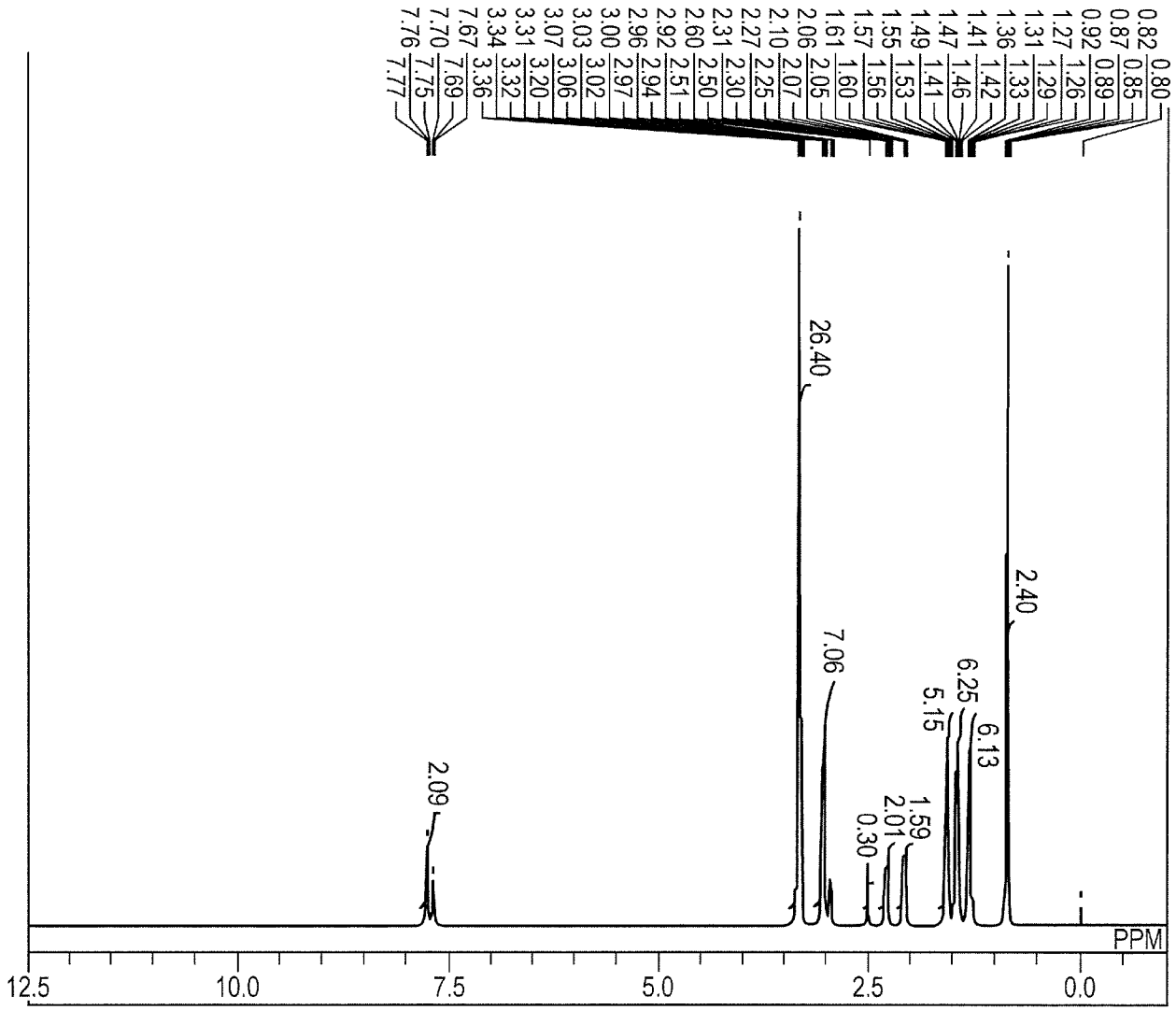
FIG. 1 is a chart showing a $^1$H-NMR spectrum in DMSO-$d_6$, at room temperature and at 400 MHz, of a compound (7) in the present invention, in what is represented by the general formula (1).

The present invention is described below in detail.

The yellow toner of the present invention is used in an image forming apparatus making use of an electrophotographic system. In the electrophotographic system, images are formed through the following steps.

A voltage is applied to a charging member to charge an electrostatic latent image bearing member electro-statically (a charging step), an electrostatic latent image is formed on the electrostatic latent image bearing member thus charged (an electrostatic latent image forming step), a toner carried on a toner carrying member is allowed to adhere to the electrostatic latent image to form a toner image on the electrostatic latent image bearing member (a developing step), the toner image is transferred to a transfer material via, or not via, an intermediate transfer member (a transfer step), and the toner image having been transferred to the transfer material is fixed (a fixing step).

However, without not necessarily being limited to the image formation of such an electrophotographic system, the above yellow toner may also used in a toner jet recording system disclosed in, e.g., a patent bulletin of Japanese Patent No. 4053633.

The present inventors have made extensive studies in order to resolve the above problems the prior art has had. As the result, they have discovered that the problems can be resolved by using a yellow toner which is a yellow toner containing a binder resin, a wax and a colorant, and containing as the colorant a compound represented by the following general formula (1) and a compound represented by the following general formula (2).

General formula (1)

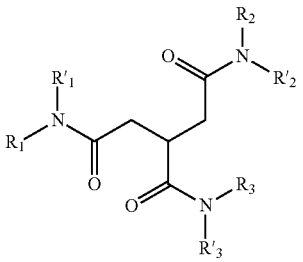

General formula (2)

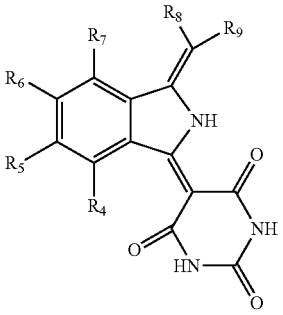

In the general formula (1), $R_1$, $R_2$, $R_3$, $R'_1$, $R'_2$ and $R'_3$ each independently represent a hydrogen atom, an alkyl group, an aryl group or an aralkyl group, and any of these may have a substituent.

The alkyl group represented by $R_1$ to $R_3$ and $R'_1$ to $R'_3$ each in the general formula (1) may include, but not particularly limited to, e.g., straight-chain, branched or cyclic alkyl groups having 1 to 20 carbon atoms. Stated specifically, they include a methyl group, a butyl group, an octyl group, a dodecyl group, a nonadecyl group, a cyclobutyl group, a cyclopentyl group, a cyclohexyl group, a methylcyclohexyl group and an ethylhexyl group.

The aryl group represented by $R_1$ to $R_3$ and $R'_1$ to $R'_3$ each in the general formula (1) may include, e.g., 6- to 14-membered ring monocyclic or polycyclic aryl groups such as a phenyl group and a naphthyl group.

The aralkyl group represented by $R_1$ to $R_3$ and $R'_1$ to $R'_3$ each in the general formula (1) may include, e.g., a benzyl group and a phenethyl group.

The substituent the above $R_1$ to $R_3$ and $R'_1$ to $R'_3$ each may have is described below.

Where $R_1$ to $R_3$ and $R'_1$ to $R'_3$ are each an alkyl group, the substituent is selected from the group consisting of an alkoxyl group, an aryl group, a monosubstituted amino group, a disubstituted amino group and a carboxyl group. Where $R_1$ to $R_3$ and $R'_1$ to $R'_3$ are each an aryl group or an aralkyl group, the substituent is selected from the group consisting of an alkyl group, an alkoxyl group, a monosubstituted amino group, a disubstituted amino group and a carboxyl group. The alkyl group may include a methyl group, an ethyl group, a propyl group and a butyl group; the aryl group may include a phenyl group; the alkoxyl group may include a methoxyl group, an ethoxyl group and a butoxyl group; the monosubstituted amino group may include a methylamino group and a propylamino group; and the disubstituted amino group may include a dimethylamino group, a dipropylamino group and an N-ethyl-N-phenyl group.

In the general formula (1), it is preferable that $R_1$, $R_2$ and $R_3$ are all the same functional groups and $R'_1$, $R'_2$ and $R'_3$ are all the same functional groups. Such a case in which these are the same in combination makes it easy to produce the compound represented by the general formula (1).

$R_1$ to $R_3$ may also preferably be alkyl groups, in view of a good dispersibility in a solvent or the like. In particular, a case is preferable in which they have a branched structure of a cyclohexyl group, methylcyclohexyl group, ethylhexyl group or the like. Besides, $R_1$ to $R_3$ may also preferably be alkyl groups having an alkoxyl group as a substituent, and, e.g., a structure containing a coordinating heteroatom, such as a butoxypropyl group, is also preferred.

In the general formula (2), $R_4$ to $R_7$ each independently represent a hydrogen atom, a halogen atom, a sulfonic acid group, a sulfonic acid ester group, a sulfonic acid amide group, a sulfonic acid salt group, a carboxylic acid group, a carboxylic acid ester group, a carboxylic acid amide group or a carboxylic acid salt group; $R_8$ and $R_9$ each independently represent a hydrogen atom, a cyano group, a carboxylic acid group, a carboxylic acid ester group, a carboxylic acid amide group, a carboxylic acid salt group or a heterocyclic group; and $R_7$ and $R_8$ may each independently combine to form a ring and $R_8$ and $R_9$ may likewise each independently combine to form a ring.

The halogen atom represented by $R_4$ to $R_7$ each in the general formula (2) may include, e.g., a fluorine atom, a chlorine atom, a bromine atom and an iodine atom.

The sulfonic acid ester group represented by $R_4$ to $R_7$ each in the general formula (2) may include, e.g., a sulfonic acid methyl ester group, a sulfonic acid ethyl ester group, a sulfonic acid propyl ester group and a sulfonic acid butyl ester group.

The sulfonic acid amide group represented by $R_4$ to $R_7$ each in the general formula (2) may include, e.g., monosubstituted amide groups such as a sulfamoyl group, a sulfonic acid methyl amide group, a sulfonic acid methyl amide group, a sulfonic acid butyl amide group, a sulfonic acid hexyl amide group and a sulfonic acid phenyl amide group; and disubstituted amide groups such as a sulfonic acid dimethyl amide group, a sulfonic acid diphenyl amide group and a sulfonic acid methyl propyl amide group.

The sulfonic acid salt group represented by $R_4$ to $R_7$ each in the general formula (2) may include, e.g., as its salts, alkali metal salts such as a sodium salt and a potassium salt; alkaline earth metal salts such as a magnesium salt and a calcium salt; amine salts such as an ammonium salt, a pyridinium salt, a piperidinium salt and a triethylammonium salt; and amino acid salts such as a tryptophan salt, a lysine salt, a leucine salt, a phenylalanine salt, a valine salt and an arginine salt.

The carboxylic acid ester group represented by $R_4$ to $R_9$ each in the general formula (2) may include, e.g., a carboxylic acid methyl ester group, a carboxylic acid ethyl ester group, a carboxylic acid propyl ester group and a carboxylic acid butyl ester group.

The carboxylic acid amide group represented by $R_4$ to $R_9$ each in the general formula (2) may include, e.g., monosubstituted amide groups such as a carbamoyl group, a carboxylic acid methyl amide group, a carboxylic acid butyl amide group, a carboxylic acid hexyl amide group and a carboxylic acid phenyl amide group; and disubstituted amide groups such as a carboxylic acid dimethyl amide group, a carboxylic acid diphenyl amide group and a carboxylic acid propyl amide group.

The carboxylic acid salt group represented by $R_4$ to $R_9$ each in the general formula (2) may include, e.g., as its salts, alkali metal salts such as a sodium salt and a potassium salt; alkaline earth metal salts such as a magnesium salt and a calcium salt; amine salts such as an ammonium salt, a pyridinium salt, a piperidinium salt and a triethylammonium salt; and amino acid salts such as a tryptophan salt, a lysine salt, a leucine salt, a phenylalanine salt, a valine salt and an arginine salt.

The heterocyclic group represented by $R_8$ and $R_9$ each in the general formula (2) may include, e.g., 4- to 10-membered ring monocyclic or bicyclic heterocyclic groups having 1 to 4 atom(s) selected from nitrogen, oxygen and sulfur. As a specific heterocyclic group, it may include, e.g., a pyridyl group, a pyrazinyl group, a pyrimidinyl group, a pyrrolyl group, a thienyl group, a furyl group, a pyranyl group, an oxazolyl group, a triazolyl group, a triazolyl group, a tetrazolyl group, an imidazolyl group, a pyrazolyl group, a morpholinyl group, a thiomorpholinyl group, a piperidinyl group, a piperazinyl group, a quinolyl group, an isoquinolyl group, an indolyl group, an isoindolyl group, a benzofuryl group and a benzothienyl group.

About a process for producing the compound represented by the general formula (1) in the present invention, an embodiment is shown below, to which, however, the production process is by no means limited.

As described below, a compound A and an amine or amine derivative may be allowed to condense to obtain a compound B. The compound B obtained and an amine or amine derivative may further be allowed to condense to obtain a compound C. On this occasion, the first-stage amine or amine derivative and the second-stage amine or amine derivative may be the same or different. Also, in respect of functional groups of the respective compounds, any known reaction such as protection-deprotection reaction or hydrolysis may optionally be added; this is a matter of appropriate choice for those skilled in the art.

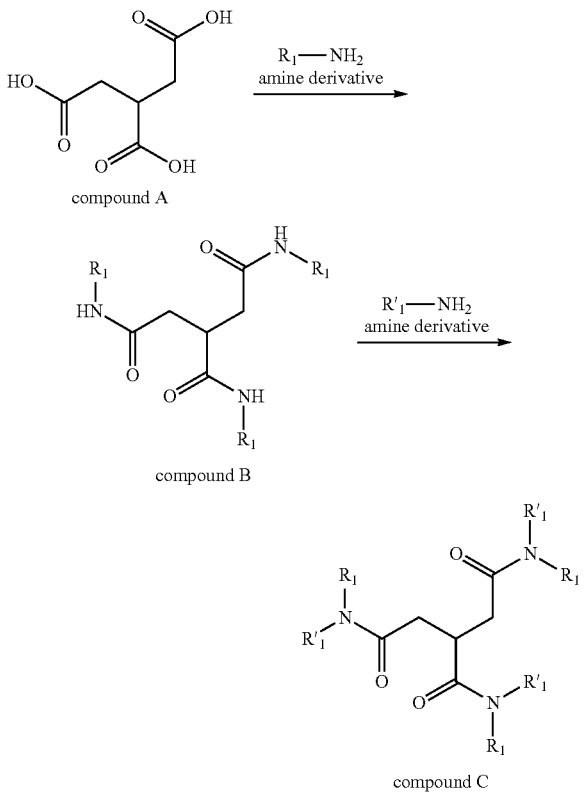

Specific examples of the compound represented by the general formula (1) are shown below, to which, however, examples are by no means limited.

Compound (1)

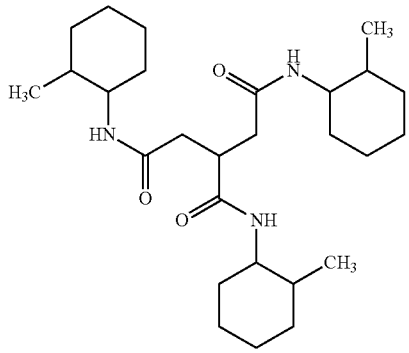

Compound (2)

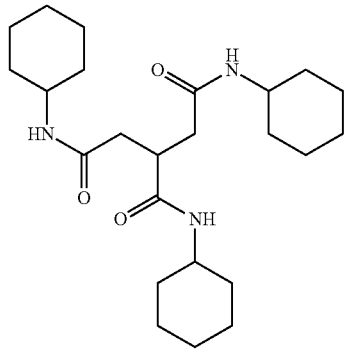

-continued
Compound (3)
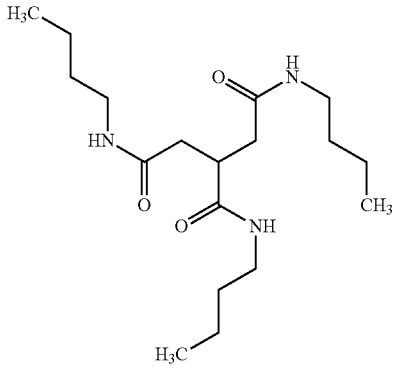
Compound (4)
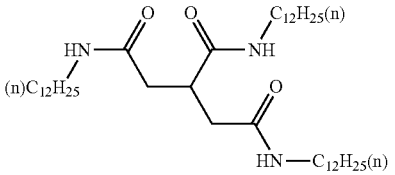
Compound (5)
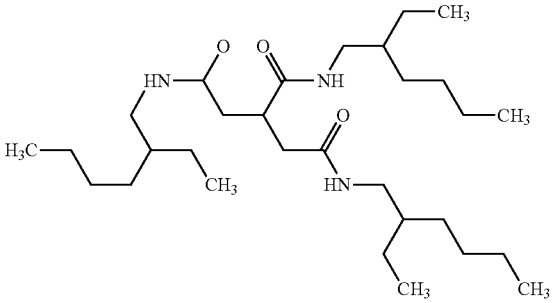
Compound (6)
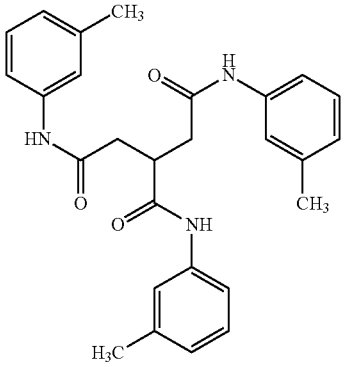
Compound (7)
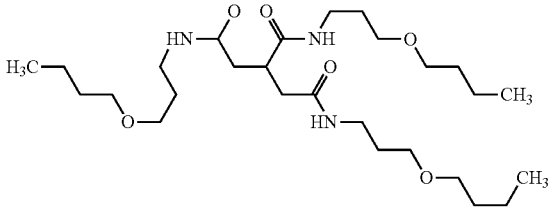
-continued
Compound (8)
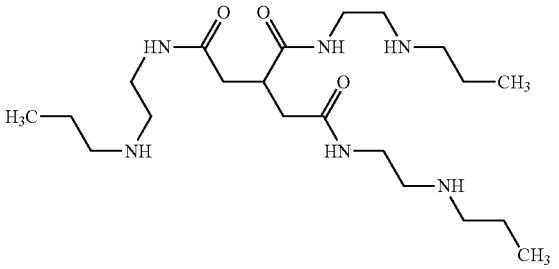
Compound (9)
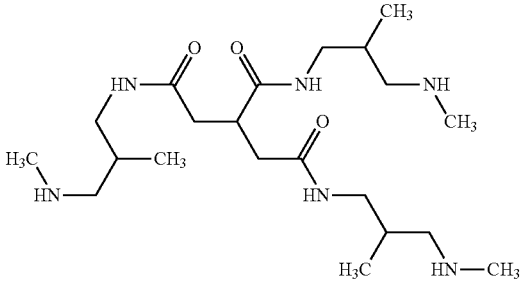
Compound (10)
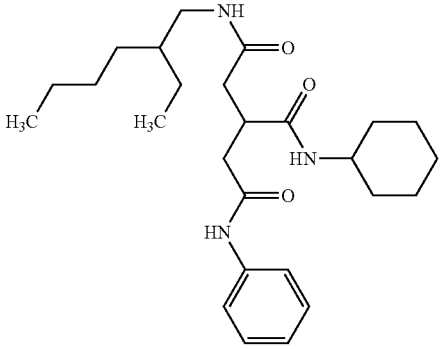
Compound (11)
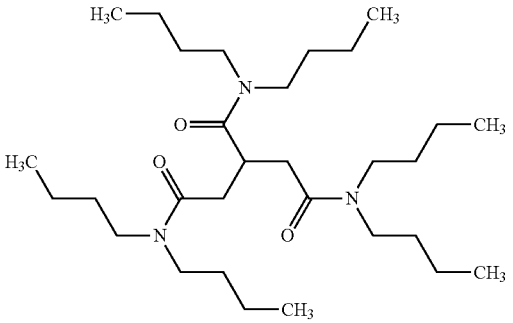
Compound (12)
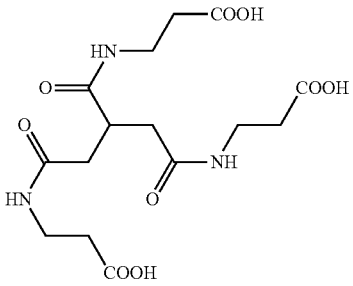

-continued

Compound (13)

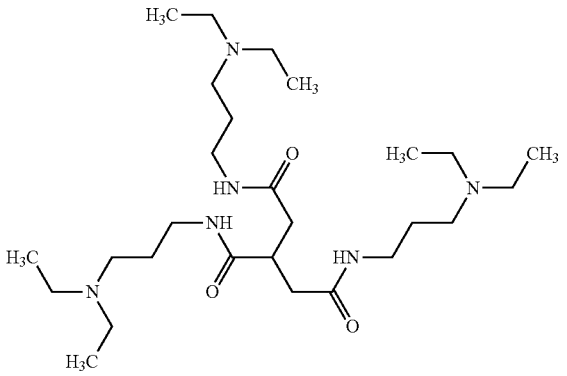

In particular, a compound having a structure wherein $R_1$, $R_2$, $R_3$, $R'_1$, $R'_2$ and $R'_3$ in the general formula (1) are identical substituents is preferable because such a compound is readily available from the viewpoint of production. A structure wherein $R_1$, $R_2$, $R_3$, $R'_1$, $R'_2$ and $R'_3$ are alkyl groups is further preferable from the viewpoint of an improvement in solubility in solvents or the like. Stated specifically, what are especially greatly effective are alkyl groups having cyclic structures as in the compound (1) and compound (2), alkyl groups having branched structures as in the compound (5), and alkyl groups substituted with alkoxyl groups as in the compound (7).

The compound (yellow pigment) represented by the general formula (2) may include, e.g., C.I. Pigment Yellow 139, C.I. Pigment Yellow 185 and yellow pigments classified as derivatives of these. C.I. Pigment Yellow 139 and C.I. Pigment Yellow 185 are represented by following chemical formulae.

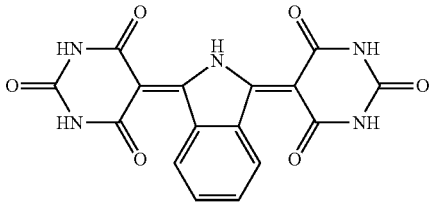

C.I. Pigment Yellow 139

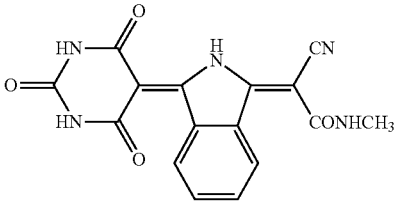

C.I. Pgiment Yellow 185

In particular, C.I. Pigment Yellow 185 has a high coloring power, and hence it is a pigment preferable as a colorant for the yellow toner. Any of these yellow pigments [the yellow pigment represented by the general formula (2)] may be used alone each or in combination of two or more types, or the yellow pigment represented by the general formula (2) and any known yellow pigment or dye may be used in combination of two or more types in total.

The compound represented by the general formula (1) and the yellow pigment represented by the general formula (2) are used in combination and this enables achievement of a good dispersed state of the yellow pigment in individual toner particles, where the compound represented by the general formula (1) may preferably be used in an amount of from 0.05 part by mass to 10 parts by mass, and much preferably from 0.1 part by mass to 5 parts by mass, based on 100 parts by mass of the yellow pigment represented by the general formula (2).

Other components to be contained in the yellow toner of the present invention are described next.

The binder resin used in toner particles constituting the yellow toner of the present invention may include a styrene-acrylate copolymer, a styrene-methacrylate copolymer, a styrene-acrylate-methacrylate terpolymer, polyester resins, a hybrid resin formed by combination of a styrene resin component (such as a styrene-acrylate copolymer, a styrene-methacrylate copolymer or a styrene-acrylate-methacrylate terpolymer) with a polyester resin component, epoxy resins, and a styrene-butadiene copolymer, which are commonly used.

As a colorant to be contained in the toner particles, the yellow pigment represented by the general formula (2) is used, and this pigment may be used in combination with other colorant. Such a colorant usable in combination may include various compounds as exemplified by condensation azo compounds, anthraquinone compounds, azo metal complexes, methine compound and allylamide compounds.

As the wax component usable in the present invention, it may include, e.g., petroleum waxes such as paraffin wax, microcrystalline wax and petrolatum, and derivatives thereof; montan wax and derivatives thereof; hydrocarbon waxes obtained by Fischer-Tropsch synthesis, and derivatives thereof; polyolefin waxes as typified by polyethylene wax, and derivatives thereof; and naturally occurring waxes such as carnauba wax and candelilla wax, and derivatives thereof. The derivatives include oxides, block copolymers with vinyl monomers, and also graft modified products. It may also include alcohols such as higher aliphatic alcohols, fatty acids such as stearic acid and palmitic acid, or compounds thereof, acid amides, esters, ketones, hardened castor oil and derivatives thereof, vegetable waxes, and animal waxes. Any of these may be used alone or in combination.

The wax component may preferably be added in such an amount that its content based on 100 parts by mass of the binder resin is in the range of from 2.5 parts by mass to 15.0 parts by mass, and much preferably from 3.0 parts by mass to 10.0 parts by mass, in total mass. As long as it is within this range, the wax component can be kept from exuding from the toner particles while good fixing performance is attained, and hence superior properties can be obtained also in regard to charging performance.

In the yellow toner of the present invention, a charge control agent may optionally be used by its internal addition or external addition to toner base particles.

As the charge control agent, any known charge control agent may be used. In particular, charge control agents which have a high charging speed and also can stably maintain a constant charge quantity are preferred. Further, where the toner base particles are directly produced by polymerization, particularly preferred are charge control agents having a low polymerization inhibitory action and substantially free of any solubilizate to an aqueous dispersion medium.

The charge control agent may include, e.g., as what is capable of controlling the toner to be negatively chargeable, polymers, or copolymers, having a sulfonic acid group, a sulfonic acid salt group or a sulfonic acid ester group; monoazo metal compounds; acetylacetone metal compounds; aromatic hydroxycarboxylic acids, or aromatic monocarboxylic acids and aromatic polycarboxylic acids, and metal compounds, anhydrides or esters thereof; phenol derivatives such as bisphenol; and also urea derivatives, metal-containing naphthoic acid compounds, boron compounds, and calixarene.

As what is capable of controlling the toner to be positively chargeable, it may also include Nigrosine and Nigrosine-modified products, modified with a fatty acid metal salt or the like; guanidine compounds; imidazole compounds; quaternary ammonium salts such as tributylbenzylammonium 1-hydroxy-4-naphthosulfonate and tetrabutylammonium tetrafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; and resin type charge control agents. Any of these may be used alone or in combination of two or more types.

To the yellow toner of the present invention, an inorganic fine powder may externally be added to the toner base particles as a fluidizing agent. As the inorganic fine powder, fine powders of, e.g., silica, titanium oxide, alumina, double oxides of any of them, and any of these having been surface-treated may be used.

As a process for producing the toner base particles constituting the yellow toner of the present invention, it may include a pulverization process, a suspension polymerization process, a suspension granulation process and an emulsion polymerization process, which are conventionally used. Of these production processes, production processes which effect granulation in an aqueous medium, such as suspension polymerization and suspension granulation, are particularly preferable from the viewpoint of any environmental load and particle diameter controllability at the time of production.

In the suspension polymerization process, the toner base particles are produced in the following way, for example.

First, a pigment dispersion (master batch) is prepared in which the pigment has been dispersed in a dispersion medium. This pigment dispersion is obtained by dispersing at least the yellow pigment represented by the general formula (2), in a dispersion medium in the presence of the compound represented by the general formula (1).

The yellow pigment represented by the general formula (2) has had a problem that it is so inferior in dispersibility as to cause an increase in viscosity when a polymerizable monomer composition in which the yellow pigment stands dispersed in a polymerizable monomer is used to perform granulation in a dispersion medium, resulting in a very poor granulation performance. However, its use in the form of the above pigment dispersion improves the colorant in its dispersibility and can prevent the increase in viscosity in the dispersion medium, so that the granulation performance required as the polymerizable monomer composition can greatly be improved.

In preparing the pigment dispersion, any known dispersion method may be used as a means for dispersing the pigment.

As a dispersion machine, a media dispersion machine such as a rotary shearing homogenizer, a ball mil, a sand mill or an attritor, or a high-pressure counter impact dispersion machine or the like may preferably be used, for example.

As the dispersion medium to be contained in the pigment dispersion, water or an organic solvent may be used in accordance with use purposes.

As the organic solvent, a polymerizable monomer may be used. In this case, the binder resin may directly be obtained by polymerizing the polymerizable monomer. Stated specifically, it may include styrene monomers such as styrene, o-methylstyrene, m-methylstyrene, p-methylstyrene, o-ethylstyrene, m-ethylstyrene and p-ethylstyrene; acrylate monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile and acrylic acid amide; methacrylate monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile and methacrylic acid amide; olefinic monomers such as ethylene, propylene, butadiene, isoprene, isobutylene and cyclohexene; vinyl halides such as vinyl chloride, vinylidene chloride, vinyl bromide and vinyl iodide; vinyl esters such as vinyl acetate, vinyl propionate and vinyl benzoate; vinyl ethers such as methyl vinyl ether, ethyl vinyl ether and isobutyl vinyl ether; and vinyl ketones such as methyl vinyl ketone, hexyl vinyl ketone and isopropenyl vinyl ketone. Any of these may be used alone or in combination of two or more types in accordance with use purposes. Of the above polymerizable monomers, any of styrene monomers, acrylate monomers and methacrylate monomers may preferably be used alone or in the form of a mixture with other polymerizable monomer. In particular, styrene is preferred.

A resin may further be added to the pigment dispersion. As the resin that may be added to the pigment dispersion, it may be selected in accordance with the use purposes, and there are no particular limitations thereon. Stated specifically, it may include, e.g., polystyrene resin, styrene copolymers, polyacrylic acid resin, polymethacrylic acid resin, polyacrylate resin, polymethacrylate resin, acrylate copolymers, methacrylate copolymers, polyester resin, polyvinyl ether resin, polyvinyl methyl ether resin, polyvinyl alcohol resin and polyvinyl butyral resin. Any of these resins may be used alone or in the form of a mixture of two or more types.

The above pigment dispersion, polymerizable monomer and wax component and a polymerization initiator and so forth are mixed to prepare a polymerizable monomer composition. Here, the above resin may also be dissolved in the polymerizable monomer when the polymerizable monomer composition is prepared. Next, the polymerizable monomer composition is dispersed in an aqueous medium to granulate the polymerizable monomer composition to form its particles. Then, the polymerizable monomer in the particles of the polymerizable monomer composition is polymerized in the aqueous medium to obtain toner base particles.

As the pigment dispersion, it is preferable that a portion of the polymerizable monomer is used as a dispersion medium and thereafter mixed with the remaining polymerizable monomer together with other toner materials. This enables the pigment to be present in the interior of the toner particles in a better dispersed state.

In the present invention, in order to enhance mechanical strength of the toner particles and also control the molecular weight of toner molecules, a cross-linking agent may be used when the binder resin is synthesized.

The cross-linking agent used in the yellow toner of the present invention may include, but not particularly limited to, e.g., as a bifunctional cross-linking agent, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester type diacrylates, and the above diacrylates each acrylate moiety of which has been replaced with methacrylate.

As a polyfunctional cross-linking agent, it may include, but not particularly limited to, e.g., pentaerythritol triacrylate, trimethylolethane triacrylate, trimethylolpropane triacrylate, tetramethylolmethane tetraacrylate, oligoester acrylate, and methacrylates of these; and 2,2-bis(4-methacryloxyphenyl) propane, diallyl phthalate, triallyl cyanurate, triallyl isocyanurate and triallyl trimellitate.

Any of these cross-linking agents may preferably be added in an amount of from 0.05 part by mass or more to 10 parts by mass or less, and much preferably from 0.1 part by mass or more to 5 parts by mass or less, based on 100 parts by mass of the polymerizable monomer.

As the polymerization initiator used in the above suspension polymerization process, it may include known polymerization initiators, and may include, e.g., azo compounds, organic peroxides, inorganic peroxides, organometallic compounds and photopolymerization initiators. Stated more specifically, it may include azo type polymerization initiators such as 2,2'-azobis(isobutyronitrile), 2,2'-azobis(2-methylbutyronitrile), 2,2'-azobis(4-methoxy-2,4-dimethylvaleronitrile, 2,2'-azobis(2,4-dimethylvalero-nitrile) and dimethyl 2,2'-azobis(isobutyrate); organic peroxide type polymerization initiators such as benzoyl peroxide, di-tert-butyl peroxide, tert-butyl peroxyisopropyl monocarbonate, tert-hexyl peroxybenzoate and tert-butyl peroxybenzoate; inorganic peroxide type polymerization initiators such as potassium persulfate and ammonium persulfate; and redox initiators such as a hydrogen peroxide-ferrous salt type, BPO-dimethylaniline type and a cerium(IV) salt-alcohol type. The photopolymerization initiator may include an acetophenone type, a benzoin ether type and a ketal type. Any of these polymerization initiators may be used alone or in combination of two or more types.

The above polymerization initiator may preferably be in an amount of from 0.1 part by mass to 20 parts by mass, and much preferably from 0.1 part by mass to 10 parts by mass, based on 100 parts by mass of the polymerizable monomer. The polymerization initiator may a little vary in type depending on methods for polymerization, and may be used alone or in the form of a mixture, making reference to its 10-hour half-life period temperature.

The aqueous medium in which the polymerizable monomer composition is to be dispersed may preferably contain a dispersion stabilizer. As the dispersion stabilizer, any known inorganic or organic dispersion stabilizer may be used. The inorganic dispersion stabilizer may include, e.g., calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. The organic dispersion stabilizer may include, e.g., polyvinyl alcohol, gelatin, methyl cellulose, methyl hydroxypropyl cellulose, ethyl cellulose, carboxymethyl cellulose sodium salt, and starch.

A nonionic, anionic or cationic surface active agent may also be used as the dispersion stabilizer. For example, it may include sodium dodecyl sulfate, sodium tetradecyl sulfate, sodium pentadecyl sulfate, sodium octyl sulfate, sodium oleate, sodium laurate, potassium stearate, and calcium oleate.

Of the above dispersion stabilizers, it is preferable to use a sparingly water-soluble inorganic dispersion stabilizer that is soluble in acids. Also, where an aqueous dispersion medium is prepared using the sparingly water-soluble inorganic dispersion stabilizer, such a dispersion stabilizer may preferably be used in such a proportion that it is in an amount ranging from 0.2 part by mass to 2.0 parts by mass based on 100 parts by mass of the polymerizable monomer. This is preferable in view of the stability of droplets in the aqueous dispersion medium of the polymerizable monomer composition. In the present invention, the aqueous dispersion medium may also preferably be prepared with use of water in an amount ranging from 300 parts by mass to 3,000 parts by mass based on 100 parts by mass of the polymerizable monomer composition.

Where the aqueous dispersion medium in which the sparingly water-soluble inorganic dispersion stabilizer has been dispersed is prepared, it may be dispersed using a commercially available dispersion stabilizer as it is. In order to obtain particles of the dispersion stabilizer which have a fine and uniform particle size, the sparingly water-soluble inorganic dispersion stabilizer may be prepared by forming it in water with high-speed stirring. For example, where tricalcium phosphate is used as the dispersion stabilizer, an aqueous sodium phosphate solution and an aqueous calcium chloride solution may be mixed under high-speed stirring to form fine particles of the tricalcium phosphate, whereby a preferable dispersion stabilizer can be obtained.

The toner base particles in the present invention may be produced by the suspension granulation process, in the case of which, too, preferable toner base particles can be obtained. The suspension granulation process does not have any heating step in its production steps, and hence the resin and the wax component can be kept from coming compatibilized with each other, which may otherwise be compatibilized when a low-melting wax is used, thus the toner can be prevented from having a low glass transition temperature because of their coming compatibilized. In addition, the choices of toner materials making up the binder resin can be broad, and also it is easy to use as a chief component the polyester resin, which is commonly considered advantageous for fixing performance. Hence, this is a production process that is advantageous when a toner is produced which has resin composition to which the suspension polymerization process is not applicable.

In the suspension granulation process, the toner base particles are produced in the following way, for example.

First, the compound represented by the general formula (1), the yellow pigment represented by the general formula (2), the binder resin, the wax component and so forth are mixed in a solvent to prepare a solvent composition. Next, the solvent composition is dispersed in an aqueous medium to granulate the solvent composition to form its particles therein to obtain a toner particle suspension. Then, the solvent is removed from the suspension obtained, thus toner base particles can be obtained.

The solvent composition in the above step may preferably be a composition which is so prepared that a fluid dispersion obtained by dispersing in a first solvent the compound represented by the general formula (1) and the yellow pigment represented by the general formula (2) is mixed with a second solvent. This can make the pigment present in the interior of the toner particles in a better dispersed state.

As the solvent usable in the suspension granulation process, it may include, e.g., hydrocarbons such as toluene, xylene and hexane; halogen-containing hydrocarbons such as methylene chloride, chloroform, dichloroethane, trichloroethane and carbon tetrachloride; alcohols such as methanol, ethanol, butanol and isopropyl alcohol; polyhydric alcohols such as ethylene glycol, propylene glycol, diethylene glycol and triethylene glycol; Cellosolves such as methyl Cellosolve and ethyl Cellosolve; ketones such as acetone, methyl ethyl ketone and methyl isobutyl ketone; ethers such as benzyl alcohol ethyl ether, benzyl alcohol isopropyl ether and tetrahydrofuran; and esters such as methyl acetate, ethyl acetate and butyl acetate. Any of these may be used alone or in the form of a mixture of two or more types. Of these, in order to readily remove the solvent in the toner particle suspension, it is preferable to use a solvent having a low boiling point and capable of dissolving the binder resin sufficiently.

The solvent may preferably be used in an amount ranging from 50 parts by mass to 5,000 parts by mass, and much preferably from 120 parts by mass to 1,000 parts by mass, based on 100 parts by mass of the binder resin.

The aqueous medium used in the suspension granulation process may also preferably be incorporated with a dispersion stabilizer. As the dispersion stabilizer, any known inorganic or organic dispersion stabilizer may be used. The inorganic dispersion stabilizer may include, e.g., calcium phosphate, calcium carbonate, aluminum hydroxide, calcium sulfate and barium carbonate. The organic dispersion stabilizer may include, e.g., water-soluble polymers such as polyvinyl alcohol, methyl cellulose, hydroxyethyl cellulose, ethyl cellulose, carboxymethyl cellulose sodium salt, sodium polyacrylate and sodium polymethacrylate; and surface active agents as exemplified by anionic surface active agents such as sodium dodecylbenzene sulfonate, sodium octadecyl sulfate, sodium oleate, sodium laurate and potassium stearate; cationic surface active agents such as laurylamine acetate, stearylamine acetate and lauryl trimethylammonium chloride; amphoteric surface active agents such as lauryl dimethylamine oxide; and nonionic surface active agents such as polyoxyethylene alkyl ethers, polyoxyethylene alkyl phenyl ethers and polyoxyethylene alkyl amines.

The dispersion stabilizer may be used in an amount ranging from 0.01 part by mass to 20 parts by mass based on 100 parts by mass of the binder resin. Such a case is preferable in that the droplets of the solvent composition can have a high stability in the aqueous medium.

The yellow toner of the present invention may preferably have a weight-average particle diameter D4 of from 4.0 μm to 9.0 μm and a ratio of weight-average particle diameter D4 to number-average particle diameter D1 (hereinafter "weight-average particle diameter D4/number-average particle diameter D1" or "D4/D1"), of 1.35 or less. It may further preferably have a weight-average particle diameter D4 of from 4.9 μm to 7.5 μm and weight-average particle diameter D4/number-average particle diameter D1 of 1.30 or less.

Incidentally, the weight-average particle diameter D4 and number-average particle diameter D1 of the yellow toner of the present invention may differ in how to control them, depending on how to produce the toner base particles. For example, in the case of suspension polymerization, they may be controlled by controlling the concentration of a dispersant used when an aqueous dispersion medium is prepared, the rate of reaction and stirring, the time for reaction and stirring, and so forth.

The yellow toner of the present invention may preferably have an average circularity of from 0.950 to 0.995, and much preferably from 0.960 to 0.990 as measured with a flow type particle image analyzer. This is preferable in that the yellow toner is greatly improved in its transfer performance.

The yellow toner of the present invention may be either of a magnetic toner and a non-magnetic toner. Where it is used as the magnetic toner, the toner particles constituting the yellow toner of the present invention may make use of a magnetic material by mixture. Such a magnetic material may include iron oxides such as magnetite, maghemite and ferrite, or iron oxides including other metal oxides; metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

Methods for measuring toner physical properties in the present invention are as shown below.

(1) Measurement of weight average particle diameter D4 and number average particle diameter D1 of toner: The number average particle diameter (D1) and weight average particle diameter (D4) of the toner are measured by particle size distribution analysis according to the Coulter method. Coulter Counter TA-II or Coulter Multisizer II (manufactured by Beckman Coulter, Inc.) is used as a measuring instrument, and measurement is made according to an operation manual attached to the instrument. As an electrolytic solution, an aqueous about −1% NaCl solution is prepared using first-grade sodium chloride. For example, ISOTON-II (available from Coulter Scientific Japan Co.) may be used.

As a specific measuring method, 0.1 to 5 ml of a surface active agent (preferably an alkylbenzenesulfonate) is added as a dispersant to 100 to 150 ml of the above aqueous electrolytic solution, and 2 to 20 mg of a sample (toner) for measurement is further added. The electrolytic solution in which the sample has been suspended is subjected to dispersion treatment for about 1 minute to about 3 minutes in an ultrasonic dispersion machine. About the dispersion-treated fluid obtained, the volume distribution and number distribution are calculated by measuring the volume and number of toner particles of 2.00 μm or more in diameter by means of the above measuring instrument, fitted with an aperture of 100 μm as its aperture. Then the number average particle diameter (D1) and weight average particle diameter (D4) (the middle value of each channel is used as the representative value for each channel) are determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

(2) Measurement of average circularity of toner:

The average circularity of the toner is measured with a flow type particle analyzer "FPIA-2100 Model" (manufactured by Sysmex Corporation), and is calculated according to the following expression.

$$\text{Circle-equivalent diameter} = \sqrt{\text{particle projected area}/\pi} \times 2$$

$$\text{Circularity} = \frac{\text{Circumferential length of a circle with the same area as particle projected area}}{\text{Circumferential length of particle projected image}}$$

Herein, the "particle projected area" is defined to be the area of a binary-coded toner particle image, and the "circumferential length of particle projected image" is defined to be the length of a contour line formed by connecting edge points of the toner particle image. The circularity is an index showing the degree of surface unevenness of toner particles. It is indicated as 1.000 when the toner particles are perfectly spherical. The more complicate the surface shape is, the smaller the value of circularity is.

EXAMPLES

The present invention is described below in greater detail by giving Examples and Comparative Examples, to which Examples, however, the present invention is by no means limited. In the following, "part(s)" and "%" are by mass unless particularly noted.

Reaction products obtained were identified by a plurality of analytical methods making use of instruments shown below. That is, as instruments used, a $^1$H nuclear magnetic resonance spectroscopic analyzer (ECA-400, manufactured by JEOL Ltd.) and a mass spectrometric analyzer LC/TOF MS (LC/MSD TOF, manufactured by Agilent Technologies Inc.).

The compound represented by the general formula (1) was produced by the method described below.

Compound (1)

The above compound (1) is readily available also as "RiKACLEAR PC1" (trade name, available from New Japan Chemical Co., Ltd.)

Compound (4)

Production Example 1

(Compound (4) Production Example)

To a 150 mL xylene solution of 13.0 g (120 mmol) of cresol, 7.0 g (40 mmol) of 1,2,3-propanetricarboxylic acid, 1.0 g (14.4 mmol) of diboron trioxide, 44.5 g (240 mmol) of n-dodecylamine was added, and these were heated and refluxed for 6 hours to effect dehydration. After the reaction was completed, the reaction product was concentrated under reduced pressure, and thereafter stirred at 50° C. for 1 hour to carry out suspension washing with 150 mL of acetonitrile. The solid formed was filtered to obtain 10.0 g of the compound (4) noted previously (yield: 37%).

Results of analysis on compound (4):

(1) $^1$H NMR(400 MHz, DMSO-$d_6$, room temperature):

δ [ppm]=0.85 (t, 9H, J=6.64 Hz), 1.17 (m, 60H), 2.50 (t, 11H, J=1.83 Hz), 7.64 (s, 1H), 8.03 (s, 1H), 10.8 (s, 1H)

(2) Mass spectrometry (ESI-TOF): m/z=676.6414(M-H)$^-$

Compounds (5) & (7)

Production Examples 2 & 3

(Compounds (5) & (7) Production Examples)

The compounds (5) and (7) were obtained in the same way as Production Example 1 except that the n-dodecylamine was changed for 2-ethylhexylamine and 3-butoxypropylamine, respectively, to obtain 7.3 g of the compound (5) noted previously (yield: 36%) and 4.8 g of the compound (7) noted previously (yield: 23%). About the compound (7), its $^1$H-NMR spectrum is shown in FIG. 1.

Results of analysis on compound (5):

(1) $^1$H NMR(400 MHz, DMSO-$d_6$, room temperature):

δ [ppm]=0.80 (td, 9H, J=7.44, 3.51 Hz), 0.86 (t, 9H, J=6.87 Hz), 1.2 (t, 24H, 8.47 Hz), 1.32 (dd, 3H, J=11.7, 5.72 Hz), 2.10 (dd, 2H, J=14.7, 6.87 Hz), 2.32 (dd, 2H, J=14.9, 8.01 Hz), 2.50 (t, 1H, J=1.83 Hz), 2.96 (dtd, 6H, J=39.1, 13.1, 6.41 Hz), 7.60 (t, 1H, 6.00 Hz), 7.68 (t, 2H, 6.00 Hz)

(2) Mass spectrometry (ESI-TOF): m/z=508.4524(M-H)$^-$

Results of analysis on compound (7):

(1) $^1$H NMR(400 MHz, DMSO-$d_6$, room temperature):

δ [ppm]=0.92-0.82 (m, 9H), 1.3 (td, 6H, J=14.9, 7.48 Hz), 1.46 (dt, 6H, J=15.7, 5.95 Hz), 1.57 (td, 6H, J=13.3, 6.4 Hz), 2.07 (dd, 2H, J=14.7, 6.41 Hz), 2.28 (dd, 2H, J=14.7, 7.79 Hz), 2.5 (t, 1H, J=1.60 Hz), 2.99 (tt, 7H, J=22.4, 7.56 Hz), 3.36-3.30 (m, 12H), 7.72 (dt, 3H, J=29.5, 5.61 Hz)

(2) Mass spectrometry (ESI-TOF): m/z=514.3906(M-H)$^-$

Compound (11)

Production Example 4

(Compound (11) Production Example)

To a 0.2 mL dimethylformamide solution of 3.5 g (20 mmol) of 1,2,3-propanetricarboxylic acid, 7.3 mL (100 mmol) of thionyl chloride was dropwise added, and thereafter these were stirred at 90° C. for 2 hours. The reaction product was concentrated under reduced pressure, and thereafter diluted with 40 mL of dichloromethane. This solution was dropwise added to a 100 mL dichloromethane solution of 10 mL of triethylamine and 12.2 mL (72 mmol) of dibutylamine, and these were stirred for 5 days. After the reaction was completed, the reaction product was diluted with 400 mL of dichloromethane, followed by washing with water, 1 mol/L hydrochloric acid, an aqueous saturated sodium hydrogencarbonate solution and saturated brine in this order. The organic layer formed was concentrated under reduced pressure, and thereafter purified by silica gel column chromatography to obtain 7.37 g of the compound (11) noted previously (yield: 72%).

Results of analysis on compound (11):

(1)$^1$H NMR (400 MHz, $CDCl_3$, room temperature):

δ [ppm]=0.99-0.84 (m, 18H), 1.69-1.23 (m, 24H), 2.53-2.45 (m, 2H), 2.63-2.55 (m, 2H), 3.31-3.12 (m, 10H), 3.46 (t, 2H, J=8.01 Hz), 3.75-3.68 (m, 1H) (2) Mass spectrometry (ESI-TOF): m/z=510.4699 (M+H)$^+$ Compound (12)

Production Example 5

(Compound (12) Production Example)

19.4 g (126.3 mmol) of β-alanine hydrochloride was suspended in 150 mL of dichloromethane. To the suspension formed, 5.56 g (31.6 mmol) of 1,2,3-propanetricarboxylic acid, 13.9 mL (126.3 mmol) of N-methyl morpholine and 24.2 g (126.3 mmol) of 1-ethyl-3-(3-dimethylaminopropyl) carbodimide (EDCI) were added, and these were stirred at room temperature overnight. The reaction solution obtained was diluted with 450 mL of dichloromethane, followed by washing with water, 1 mol/L hydrochloric acid, an aqueous saturated sodium hydrogencarbonate solution and saturated brine in this order. The organic layer formed was concentrated under reduced pressure, and thereafter the residue obtained was washed with ethanol and diethyl ether in this order to obtain 11.2 g of the compound (12) noted previously (yield: 75%).

Results of analysis on compound (12):

(1) $^1$H NMR(400 MHz, $CDCl_3$, room temperature):

δ [ppm]=2.07(dd, 2H, J=14.88, 6.64 Hz), 2.31 (ddd, 8H, J=32.06, 15.57, 8.70 Hz), 2.96-2.88 (m, 1 H), 3.20 (tt, 6H, J=19.23, 6.56 Hz), 7.75 (t, 1H, J=5.72 Hz), 7.85 (t, 2H, J=5.50 Hz), 12.19 (s, 3H)3H)

(2) Mass spectrometry (ESI-TOF): m/z=388.1697$(M+H)^+$
Compound (13)

Production Example 6

(Compound (13) Production Example)

To a 80 mL methanol solution of 3.5 g (20 mmol) of 1,2,3-propanetricarboxylic acid, 12.6 mL (80 mmol) of N,N-diethyl-1,3-diaminopropane and 22.1 g (80 mmol) of 4-(4,6-dimethoxy-1,3,5-triazin-2-yl)-4-methyl morpholinium chloride (DMT-MM) were added, and these were stirred at room temperature for 3 days. The reaction solution obtained was concentrated under reduced pressure, and thereafter purified by silica gel column chromatography to obtain 2.1 g of the compound (13) noted previously (yield: 20%).

Results of analysis on compound (13):

(1) $^1$H NMR(400 MHz, $CDCl_3$, room temperature):

δ [ppm]=1.02 (tt, 18H, J=15.57, 6.49 Hz), 1.62 (dt, 6H, J=17.71, 5.38 Hz), 2.17(s, 2H), 2.35 (dd, 2H, J=14.65, 5.04 Hz), 2.54-2.44 (m, 18H), 3.14-3.10 (m, 1H), 3.28 (dq, 6H, J=25.87, 6.56 Hz), 7.56 (3H, t, J=5.27 Hz) (2) Mass spectrometry (ESI-TOF): m/z=513.4603 $(M+H)^+$ Example 1

A mixture of 0.12 parts of the compound (1), 12 parts of C.I. Pigment Yellow 185 (trade name: PALIOTOL Yellow D1155, available from BASF Corp.) and 120 parts of styrene was put to dispersion for 3 hours by means of an attritor (manufactured by Mitsui Mining and Smelting Co., Ltd.) to obtain a pigment dispersion (1).

Meanwhile, into a 2-liter four-necked flask equipped with a high-speed stirrer T.K. homomixer (manufactured by PRIMIX Corporation), 710 parts of ion-exchanged water and 450 parts of an aqueous 0.1 mol/L trisodium phosphate solution were introduced, and then heated to 60° C., controlling the number of revolutions of the homomixer at 12,000 rpm. To the resultant mixture, 68 parts of an aqueous 1.0 mol/L calcium chloride solution was slowly added to prepare an aqueous dispersion medium containing a sparingly water-soluble dispersant calcium chloride.

| | |
|---|---|
| Pigment dispersion (1) | 133.2 parts |
| Styrene monomer | 46.0 parts |
| n-Butyl acrylate monomer | 34.0 parts |
| 3,5-Di-t-butylsalicylic acid aluminum compound (BONTRON E-88, available from Orient Chemical Industries, Ltd.) | 2.0 parts |
| Polar resin (polycondensation product of propylene oxide modified bisphenol A with isophthalic acid; glass transition temperature Tg: 65° C.; weight-average molecular weight Mw: 10,000; number-average molecular weight Mn: 6,000) | 10.0 parts |
| Ester wax (peak temperature of maximum endothermic peak in DSC measurement: 70° C.; Mn: 704) | 25.0 parts |
| Divinylbenzene monomer | 0.10 part |

What was formulated as above was heated to 60° C. and put to uniform dissolution and dispersion by means of the TK homomixer at 5,000 rpm. In the mixture obtained, 10 parts of a polymerization initiator 2,2'-azobis(2,4-dimethylvaleronitrile) was dissolved to prepare a polymerizable monomer composition. This polymerizable monomer composition was introduced into the above aqueous dispersion medium to carry out granulation for 15 minutes while keeping the number of revolutions of 12,000 rpm. Thereafter, the high-speed stirrer was changed for a stirrer having propeller stirring blades, and, keeping the liquid temperature at 60° C., the polymerization was continued for 5 hours. Thereafter, the liquid temperature was raised to 80° C., and the polymerization was continued for 8 hours. After the polymerization reaction was completed, residual monomers were evaporated off at 80° C. under reduced pressure, followed by cooling to a liquid temperature of 30° C. to obtain a fine polymer particle dispersion.

Next, the fine polymer particle dispersion was moved to a washing container, and diluted hydrochloric acid was added thereto with stirring to make adjustment to pH 1.5. The mixture obtained was stirred for 2 hours, followed by solid-liquid separation by means of a filter to obtain fine polymer particles. The fine polymer particles obtained were put to redispersion in water and solid-liquid separation which were repeated until the compound of phosphoric acid and calcium, containing calcium chloride, was completely removed. Thereafter, the fine polymer particles obtained as a result of solid-liquid separation carried out finally were sufficiently dried by means of a dryer to obtain yellow toner base particles (1).

In 100 parts of the yellow toner base particles (1) obtained, 1.00 part of hydrophobic fine silica powder having been surface-treated with hexamethyldisilazane (number-average primary particle diameter: 7 nm), 0.15 part of fine rutile titanium oxide powder (number-average primary particle diameter: 45 nm) and 0.50 part of fine rutile titanium oxide powder (number-average primary particle diameter: 200 nm) were dry-process mixed for 5 minutes by means of Henschel mixer (manufactured by Nippon Coke & Engineering Co., Ltd.) to obtain a yellow toner (1).

Example 2

A yellow toner (2) was obtained in the same way as Example 1 except that the salicylic acid aluminum compound was not used.

Examples 3 to 11

Yellow toners (3) to (11) were obtained in the same way as Example 1 except that their formulation was changed for the formulation shown in Table 1.

Comparative Example 1

A comparative yellow toner (1) was obtained in the same way as Example 2 except that the compound (1) was not used.

Comparative Examples 2 & 3

Comparative yellow toners (2) and (3) were obtained in the same way as Example 1 except that their formulation was changed for the formulation shown in Table 1.

Evaluation of Granulation Performance

In regard to granulation performance, it was evaluated by the value of the ratio of weight-average particle diameter D4 to number-average particle diameter D1 (D4/D1). The results of evaluation are shown in Table 1.

A (the granulation performance is very good): The value of D4/D1 is 1.10 or more to less than 1.35.

B (the granulation performance is good): The value of D4/D1 is 1.35 or more to less than 2.00.

C (the granulation performance is poor): The value of D4/D1 is 2.00 or more.

TABLE 1

| | Toner No. | Formula (1) = compound No. | Pigment | D50 | D4/D1 | Granulation performance | Av. circularity | Proportion of particles (vol. %) Less than 2.52 μm | Proportion of particles (vol. %) 10.0 μm or more |
|---|---|---|---|---|---|---|---|---|---|
| Example: | | | | | | | | | |
| 1 | 1 | (1) | PY185 | 6.18 | 1.29 | A | 0.985 | 2.0 | 0.7 |
| 2 | 2 | (1) | PY185 | 6.64 | 1.33 | A | 0.978 | 2.3 | 0.9 |
| 3 | 3 | (4) | PY185 | 7.34 | 1.34 | A | 0.965 | 2.6 | 0.9 |
| 4 | 4 | (5) | PY185 | 7.22 | 1.34 | A | 0.961 | 2.7 | 0.9 |
| 5 | 5 | (7) | PY185 | 6.14 | 1.26 | A | 0.984 | 2.1 | 0.8 |
| 6 | 6 | (11) | PY185 | 6.09 | 1.33 | A | 0.963 | 2.5 | 0.9 |
| 7 | 7 | (12) | PY185 | 6.33 | 1.33 | A | 0.970 | 2.1 | 0.8 |
| 8 | 8 | (13) | PY185 | 6.26 | 1.29 | A | 0.984 | 2.2 | 0.8 |
| 9 | 9 | (1) | PY139 | 6.89 | 1.35 | A | 0.966 | 2.4 | 0.9 |
| 10 | 10 | (11) | PY139 | 7.12 | 1.32 | A | 0.963 | 2.1 | 0.9 |
| 11 | 11 | (13) | PY139 | 7.30 | 1.36 | A | 0.984 | 2.2 | 0.9 |
| Comparative Example: | | | | | | | | | |
| 1 | Cp(1) | None | PY185 | 9.82 | 2.47 | C | 0.941 | 5.2 | 7.3 |
| 2 | Cp(2) | None | PY185 | 11.1 | 2.78 | C | 0.923 | 6.4 | 8.6 |
| 3 | Cp(3) | None | PY139 | 10.8 | 2.99 | C | 0.904 | 6.8 | 7.6 |

Cp: Comparative toner
PY: C.I. Pigment Yellow

Examples 12 to 22 & Comparative Examples 4 to 6

Evaluation of Image Samples Making Use of Yellow Toners

Next, using the above 14 types of yellow toners, image samples were reproduced to compare and evaluate image characteristics as described later. Here, in comparing the image characteristics, paper feed running was tested which made use of a conversion machine of LBP-5300 (manufactured by CANON INC.) as an image forming apparatus (hereinafter simply "LBP"). As a conversion item, a developing blade in its process cartridge (hereinafter "CRG") was changed for a SUS stainless steel blade of 8 μm in thickness. After such conversion, it was so designed that a blade bias of −200 V was applicable to the development bias to be applied to a toner carrying member developing roller.

In evaluating the image characteristics, CRGs loaded individually with the respective yellow toners were readied for each evaluation item. Then, for each CRG loaded with each yellow toner, this was set in the LBP and the evaluation was made as described below.

As evaluation items, comparison was made on three items of image fog, development streaks and sharpness.

Here, as evaluation environments, the evaluation was made in three environments of:

1) normal-temperature/normal-humidity environment (N/N; 23° C., 55% RH) (hereinafter simply "N/N environment");

2) low-temperature/low-humidity environment (L/L; 15° C., 10% RH) (hereinafter simply "L/L environment"); and 3) high-temperature/high-humidity environment (H/H; 30° C., 80% RH) (hereinafter simply "H/H environment");

among which, about the sharpness, the evaluation was made only in the N/N environment and, about the remaining two items, the evaluation was made in the three environments.

It turned out that, all as shown in Table 2 later, the use of the yellow toners of the present invention enabled achievement of better results than the yellow toners of Comparative Examples, on all the above image evaluation items.

Specific evaluation methods for the respective evaluation items are shown below.

Image fog:

The image fog refers to a phenomenon that the toner is laid on a place where normally any toner should not be laid on (hereinafter referred to as "white-background area"). Thus, the lower density the white-background area has, the better the images are. Especially where a toner having fine powder in a large proportion, such a toner tends to cause melt-sticking onto the surface of the developing blade provided in the CRG. As the result, a toner not provided with any sufficient charge quantity may increase to cause the image fog unwantedly in non-image areas.

Accordingly, in order to inspect the image fog, first, images having the white-background area were reproduced by using a CRG standing after paper feed running made on 15,000 sheets. Thereafter, whiteness of the white-background area of the images having been reproduced [reflectance Ds(%)] was measured with "Digital White Photometer TC-6D" (manufactured by Tokyo Denshoku Co., Ltd.). Average whiteness of the same production lot in evaluation paper shown below on which any images were not reproduced [average reflectance Dr(%)] was also measured together therewith. Then, from the difference between the both, fog density (%) [=Dr(%)−Ds(%)] was calculated to make quantitative any image fog occurring during the running evaluation.

As conditions set in making evaluation, a blue filter was used to make the evaluation. Also, as evaluation paper, "Image Coat Gloss 128" (A4 size) (available from CANON Marketing Japan Inc.) was used.

The results of fog evaluation made under the above conditions were evaluated according to ranks shown below.

When evaluated as Rank D or E, the fog is at such a level as to be able to notice the white-background area being yellowish. Hence, it is preferable to be evaluated as Rank C or higher.

A: Less than 1.0%.

B: 1.0% or more to less than 2.0%.

C: 2.0% or more to less than 4.0%.

D: 4.0% or more to less than 6.0%.

E: 6.0% or more.

Development Streaks:

The development streaks refer to a phenomenon that the toner melt-sticks partly onto the surface of the developing blade described previously and this makes the toner-coat on the developing roller disordered to cause streaky non-uniformity on images.

Thus, the development streaks tend to occur as the fine powder is in a large proportion like the above image fog.

In order to ascertain the occurrence of any development streaks, an image in which uniform fixed-toner images were formed on paper for reproduction (hereinafter referred to as solid black images and halftone images) was used at intervals of 1,000-sheet reproduction during the 15,000-sheet continuous paper feed running. As evaluation paper, "CS-814" (A4 size) (available from CANON Marketing Japan Inc.) was used.

To judge whether or not any development streaks occurred, the solid black images and halftone images were visually observed to make inspection. As evaluation ranks, judgment criteria shown below were used. Here, since the development streaks stood visually ascertainable, a case in which any development streaks did not occur up to 12,000-sheet running capable of securing a sufficient margin for the number of sheets endurable on actual service used in the LBP used this time was judged to be at a preferable level.

A: Any development streaks do not occur up to 15,000-sheet running.

B: The development streaks occur on 14,001- to 15,000-sheet running.

C: The development streaks occur on 12,001- to 14,000-sheet running.

D: The development streaks occur on 10,001- to 12,000-sheet running.

E: The development streaks occur before 10,000-sheet running.

Sharpness:

The sharpness is, stated specifically, an index that shows the reproducibility of fine-image areas such as fine lines (e.g., lines corresponding to 1 dot each in images of 600 dpi in image resolution. Thus, the reproducibility tends toward poor levels unwantedly, as fine powder and coarse powder are in larger proportions in toner particle size distribution.

Figure 2:
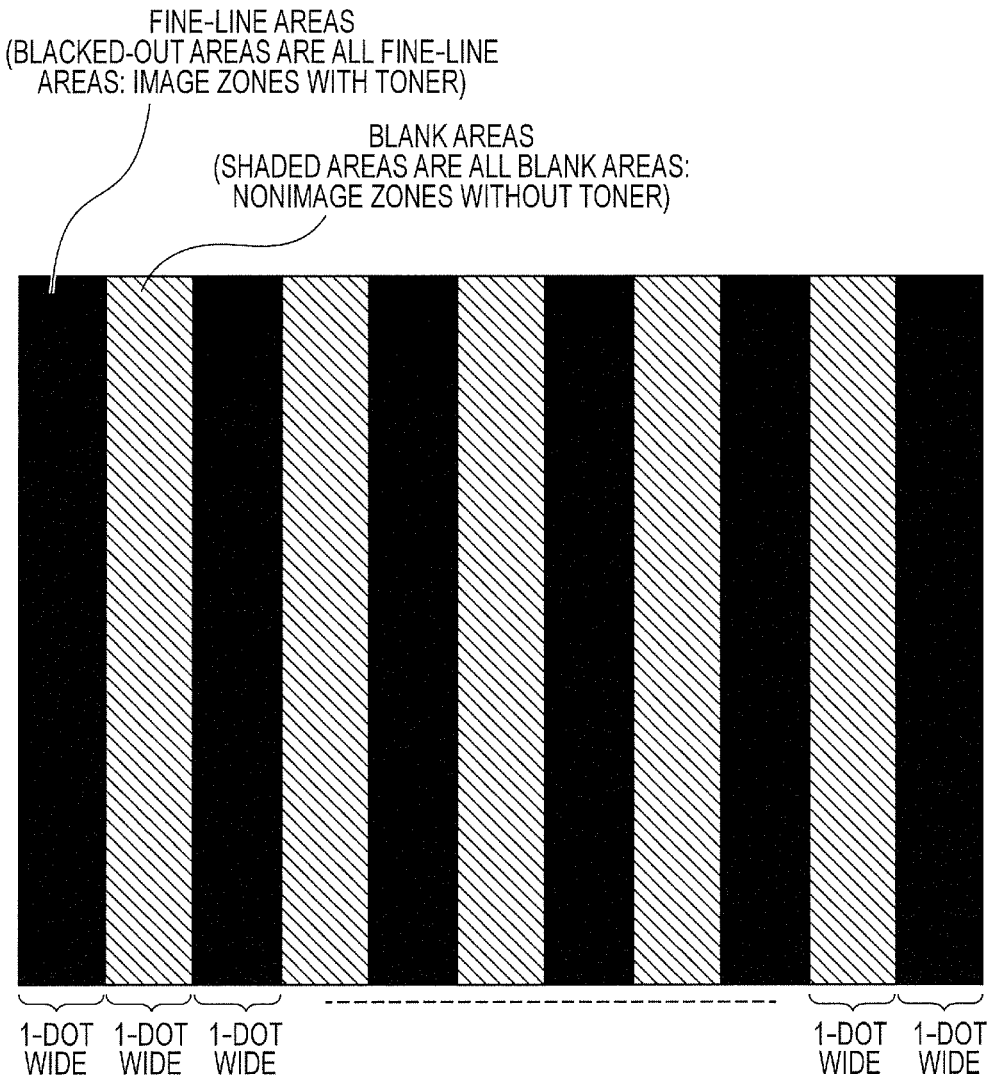
FIG. 2 shows an example of an image pattern for the evaluation of sharpness in evaluating and inspecting images in Examples.

Accordingly, as an evaluation method for the sharpness, first, an image pattern in which, as shown in FIG. 2, fine-line areas of 1 dot each in width and blank areas corresponding to the 1 dot each are alternately repeated (hereinafter simply "1-dot/1-space image") was reproduced using the LBP.

Here, what was used in reproducing the images was the same CS-814 (A4 size) as the evaluation paper for the development streaks. Also, uniform solid images of 5 cm square were simultaneously reproduced on the same paper for reproduction as the above. Thereafter, the images thus reproduced were captured by using a high-resolution scanner NEXSCAN F4200 (manufactured by Heiderberger Druckmaschinen AG) and under conditions of a resolution of 5,080 dpi and 1,024 pixel×1,024 pixel.

From the scanner images captured, the amplitude of chroma present in the 1-dot/1-space image (hereinafter simply "chroma difference (A)") and the difference in chroma between the blank areas and the uniform solid image areas of the paper for reproduction (hereinafter simply "chroma difference (B)") were calculated. Incidentally, the chroma (C*) is what is defined by the equation of $C^*=\{(a^*)^2+(b^*)^2\}^{1/2}$, using a* and b* indicated in the chromaticity value of CIE 1976 L*a*b*. Then, the sharpness is defined to be the value calculated from the following expression.

Sharpness=chroma difference (A)/chroma difference (B).

It can be said that, the closer to 1 the value of the sharpness is, the higher the sharpness is because the chroma differences come smaller.

Figure 3:
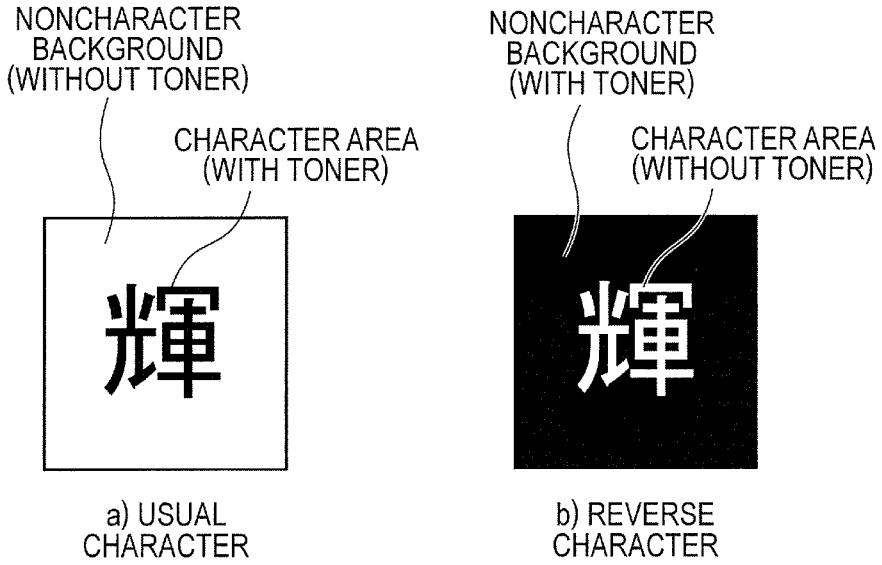
FIG. 3 shows an example of a reverse character image adopted in a passage for the description of sharpness in evaluating and inspecting images in Examples.

At levels of Ranks A, B and C, these were judged to be preferable levels because, in a reverse character [FIG. 3, b)] the number of strokes of which is 15 and the size of which is 3 pt, where, as shown in the drawing, the part of lines constituting the character (hereinafter simply "character area") is made as a non-image area without toner and the part excluding the character area ("non-character background" in the drawing) is made as an image area with toner), the character area stood in such an extent as to be partly covered with the toner even in a case of being most poorly visually recognizable.

A: 0.25 or more.

B: 0.20 or more to less than 0.25.

C: 0.15 or more to less than 0.20.

D: 0.10 or more to less than 0.15.

E: Less than 0.10.

TABLE 2

| | | Image evaluation | | | | | | |
|---|---|---|---|---|---|---|---|---|
| | | Image fog | | | Development streaks | | | Sharpness |
| | Toner No. | N/N environ. | L/L environ. | H/H environ. | N/N environ. | L/L environ. | H/H environ. | N/N environ. |
| Example: | | | | | | | | |
| 12 | 1 | A | A | B | A | B | A | A |
| 13 | 2 | B | A | B | B | B | A | B |
| 14 | 3 | B | A | B | B | B | A | C |
| 15 | 4 | B | A | B | B | B | A | B |
| 16 | 5 | A | A | B | A | A | A | A |
| 17 | 6 | A | A | B | A | A | A | A |
| 18 | 7 | A | A | B | A | B | A | A |
| 19 | 8 | A | A | B | A | B | A | A |
| 20 | 9 | B | A | B | B | B | A | B |

TABLE 2-continued

| | | Image evaluation | | | | | | |
|---|---|---|---|---|---|---|---|---|
| | | Image fog | | | Development streaks | | | Sharpness |
| | Toner No. | N/N environ. | L/L environ. | H/H environ. | N/N environ. | L/L environ. | H/H environ. | N/N environ. |
| 21 | 10 | B | A | B | B | B | A | B |
| 22 | 11 | B | A | B | B | B | A | C |
| Comparative Example: | | | | | | | | |
| 4 | Cp(1) | C | B | D | C | D | C | E |
| 5 | Cp(2) | C | B | D | C | E | C | E |
| 6 | Cp(3) | C | C | D | C | E | C | E |

Cp: Comparative toner

According to the present invention, a yellow toner having the colorant in a good dispersed state can be obtained. The use of such a yellow toner enables application to an image forming apparatus employing an electrophotographic system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-142669, filed Jun. 28, 2011, which is hereby incorporated by reference herein in its entirety.

The invention claimed is:

1. A yellow toner comprising yellow toner particles each containing a binder resin, a wax and a colorant; the colorant comprising a compound represented by the following general formula (1) and a compound represented by the following general formula (2):

General formula (1)

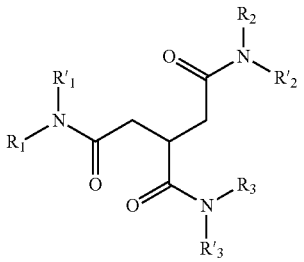

wherein $R_1$, $R_2$, $R_3$, $R'_1$, $R'_2$ and $R'_3$ each independently represent a hydrogen atom, an alkyl group, an aryl group or an aralkyl group, and any of these may have a substituent; and General formula (2)

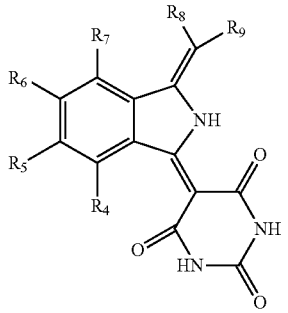

wherein $R_4$ to $R_7$ each independently represent a hydrogen atom, a halogen atom, a sulfonic acid group, a sulfonic acid ester group, a sulfonic acid amide group, a sulfonic acid salt group, a carboxylic acid group, a carboxylic acid ester group, a carboxylic acid amide group or a carboxylic acid salt group; $R_8$ and $R_9$ each independently represent a hydrogen atom, a cyano group, a carboxylic acid group, a carboxylic acid ester group, a carboxylic acid amide group, a carboxylic acid salt group or a heterocyclic group;

and $R_7$ and $R_8$, or $R_8$ and $R_9$, may each independently combine to form a ring.

2. The yellow toner according to claim 1, wherein, in the general formula (1), $R_1$ to $R_3$ are the same functional groups.

3. The yellow toner according to claim 1, wherein, in the general formula (1), $R_1$ to $R_3$ are alkyl groups.

4. The yellow toner according to claim 1, wherein the compound represented by the general formula (2) is C.I. Pigment Yellow 185.

* * * * *